US007438127B2

(12) United States Patent
Lesko

(10) Patent No.: US 7,438,127 B2
(45) Date of Patent: Oct. 21, 2008

(54) PIPE GRIPPING CLAMP

(76) Inventor: Gerald Lesko, 4807-68 Avenue, Edmonton, Alberta (CA) T6B 2N2

( * ) Notice: Subject to any disclaimer, the term of this patent is extended or adjusted under 35 U.S.C. 154(b) by 305 days.

(21) Appl. No.: 11/400,918

(22) Filed: Apr. 10, 2006

(65) Prior Publication Data

US 2007/0095524 A1 May 3, 2007

(30) Foreign Application Priority Data

Nov. 3, 2005 (CA) ..... 2525338

(51) Int. Cl.
*E21B 19/16* (2006.01)

(52) U.S. Cl. ..... 166/85.1; 166/77.51; 166/379

(58) Field of Classification Search ..... 166/85.1, 166/77.51, 379
See application file for complete search history.

(56) References Cited

U.S. PATENT DOCUMENTS 6,206,096 B1 * 3/2001 Belik ..... 166/77.51
7,017,450 B2 * 3/2006 Bangert ..... 81/57.33
7,055,594 B1 * 6/2006 Springett et al. ..... 166/85.1

* cited by examiner

*Primary Examiner*—Shane Bomar
(74) *Attorney, Agent, or Firm*—Dinsmore & Shohl LLP

(57) ABSTRACT

A pipe-gripping clamp assembly is provided for use on a top drive unit to grip sections of drilling pipe. The clamp assembly includes of a pair of hinged jaws that are opened and closed by a pair of rams attached to the jaws and the frame members that make up the assembly. Each jaw has a jaw insert that is surfaced to firmly grip a pipe and can be easily replaced once worn beyond service. The rams are either hydraulically or pneumatically operated.

5 Claims, 7 Drawing Sheets

PIPE GRIPPING CLAMP

FIELD OF THE INVENTION

The present invention relates to the field of clamps used to grip sections of drilling pipe used on a drilling rig. Specifically, the present invention relates to the field of clamps on top drive units used to grasp sections of pipe that are connected to or disconnected from the top drive unit.

BACKGROUND OF THE INVENTION

In addition to rotary tables used to rotate drilling pipe in well drilling operations, top drive motor units are also used to rotate drilling pipe. As sections of pipe are tripped into or out of the drill string on drilling rigs having top drive units, it is desirable to have a pipe clamp sub-assembly on the top drive unit that is capable of gripping a section of pipe and drawing it towards or away from the quill of the top drive unit when making or breaking connections between the pipe and the top drive unit.

SUMMARY OF THE INVENTION

In accordance with an embodiment of the present invention, a pipe gripping clamp is provided for use on a top drive motor to grip sections of drilling pipe. The clamp can comprise a frame consisting of a planar bottom plate having a pair of scissor jaws pivotally attached thereon. The jaws are hinged at one point and are capable of gripping a section of pipe. Specifically, the jaws are hinged about a pivot rod projecting upwardly from the bottom plate, the rod having a longitudinal axis that is substantially perpendicular to the surface of the bottom plate. In addition, two rams are pivotally attached to the bottom plate, one for each of the pair of jaws. Each ram can be operatively coupled to a jaw whereby the jaws close together to grip a section of pipe when the rams are extended and open up when the rams retract. The rams can be operated using hydraulic or pneumatic control systems as well known to those skilled in the art.

A planar top plate operatively attached to the frame covers the rams and the scissor jaws and provides second pivot support point for each of the rams and the scissor jaws. Furthermore, each jaw can have a replaceable jaw insert for gripping a pipe. As the insert wears out, it can be replaced without replacing the jaws themselves.

It is an aspect of the present invention to provide a pipe gripping clamp that is compact in its physical configuration yet powerful enough to grip sections of pipe.

It is another aspect of the present invention to provide a pipe gripping sub-assembly to a top drive unit that is capable of gripping a section of pipe and drawing it towards the top drive unit to make a connection with the top drive unit quill.

Broadly stated, one aspect of the present invention is a pipe gripping clamp, comprising: a bottom plate; a pair of scissor jaws capable of gripping a pipe pivotally attached to said bottom plate, said jaws capable of pivoting about a pivot axis that is substantially perpendicular to said bottom plate; and a ram operatively coupled to each of said pair of scissor jaws, each ram pivotally attached to said bottom plate and capable of pivoting about an axis that is substantially parallel to said pivot axis, whereby said jaws close to grip said pipe when said rams are extended and said jaws open to release said pipe when said rams are retracted.

Broadly stated, another aspect of the present invention is a pipe gripping assembly for a top drive unit, comprising: a pipe gripping clamp sub-assembly, comprising: a bottom plate, a pair of scissor jaws capable of gripping a pipe pivotally attached to said bottom plate, said jaws capable of pivoting about a pivot axis that is substantially perpendicular to said bottom plate; and a ram operatively coupled to each of said pair of scissor jaws, each ram pivotally attached to said bottom plate and capable of pivoting about an axis that is substantially parallel to said pivot axis, whereby said jaws close to grip said pipe when said rams are extended and said jaws open to release said pipe when said rams are retracted; a pair of guide rails operatively coupling said clamp sub-assembly to said top drive unit whereby said clamp sub-assembly is capable of moving towards and away from a quill operatively mounted on said top drive unit along an axis that is substantially parallel to the longitudinal axis of said quill; and means for moving said clamp sub-assembly along said guide rails.

DETAILED DESCRIPTION OF EMBODIMENTS

A pipe-gripping clamp is provided for use on a top drive motor unit used on a drilling rig to grip sections of pipe. The clamp comprises a pair of scissor jaws that provides the clamping mechanism to grip a pipe. The clamp is mounted on a telescoping boom such that it forms a clamp assembly. When not in use, the clamp assembly can be positioned in a raised position with respect to the top drive unit. When a pipe is to be connected to the top drive unit, the clamp assembly is lowered when the telescoping boom is extended until the clamp jaws straddle the pipe. The jaws are then firmly closed about the pipe and the boom is retracted thereby raising the pipe to be connected to the top drive unit.

Figure 1:
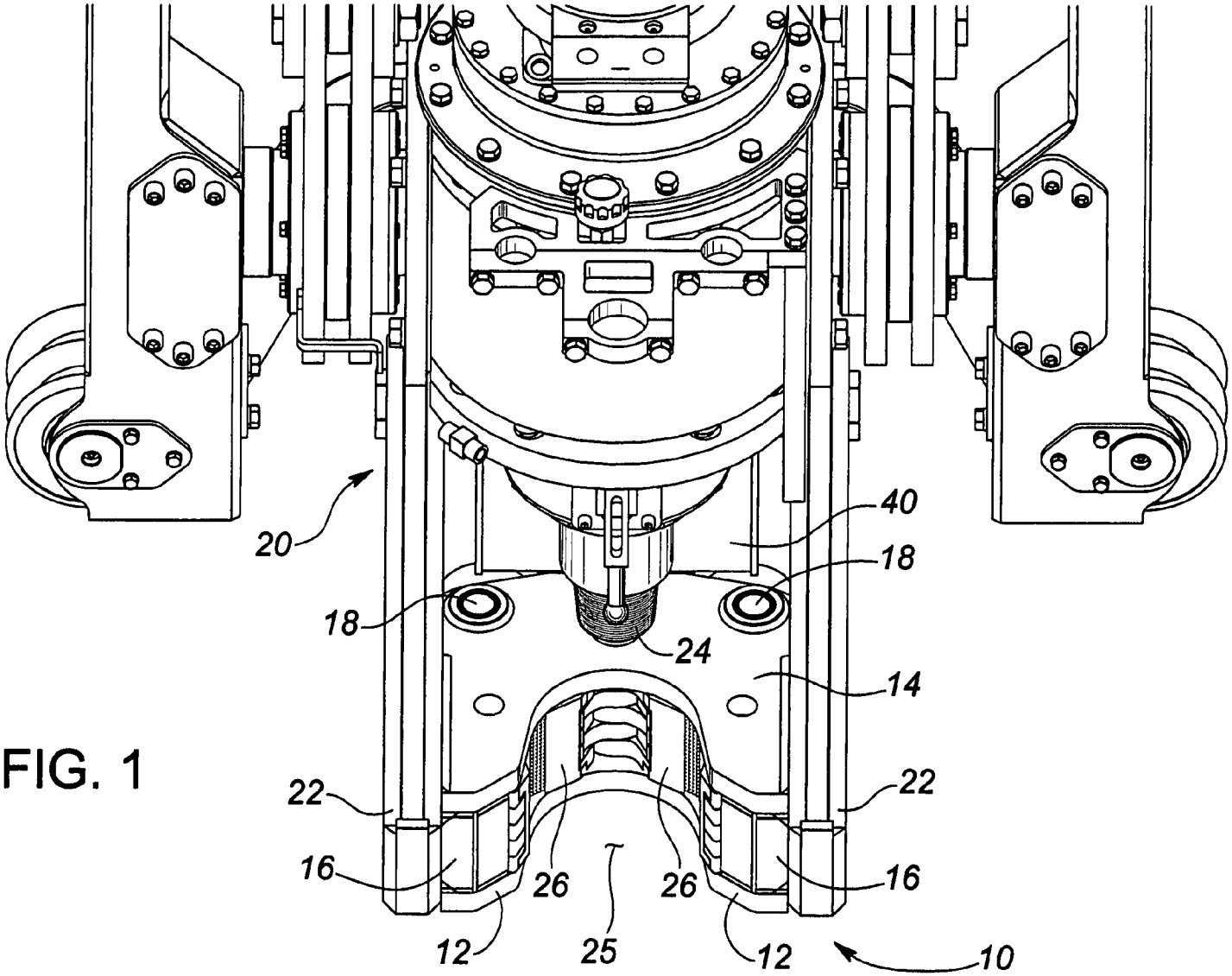
FIG. 1 is a front perspective view depicting a representative embodiment of a pipe gripping clamp with the scissor jaws open.

Referring to FIG. 1, clamp assembly 10 is shown. Clamp assembly 10 comprises bottom plate 12 (which is attached to guide rails 22), telescoping boom 40, top plate 14 and front covers 16. Disposed between top and bottom plates 14 and 12, and behind front covers 16, are jaws 26 hinged together to form scissor jaws 25. Guide rails 22 and boom 40 connect clamp assembly 10 to top drive unit 20.

Figure 2:
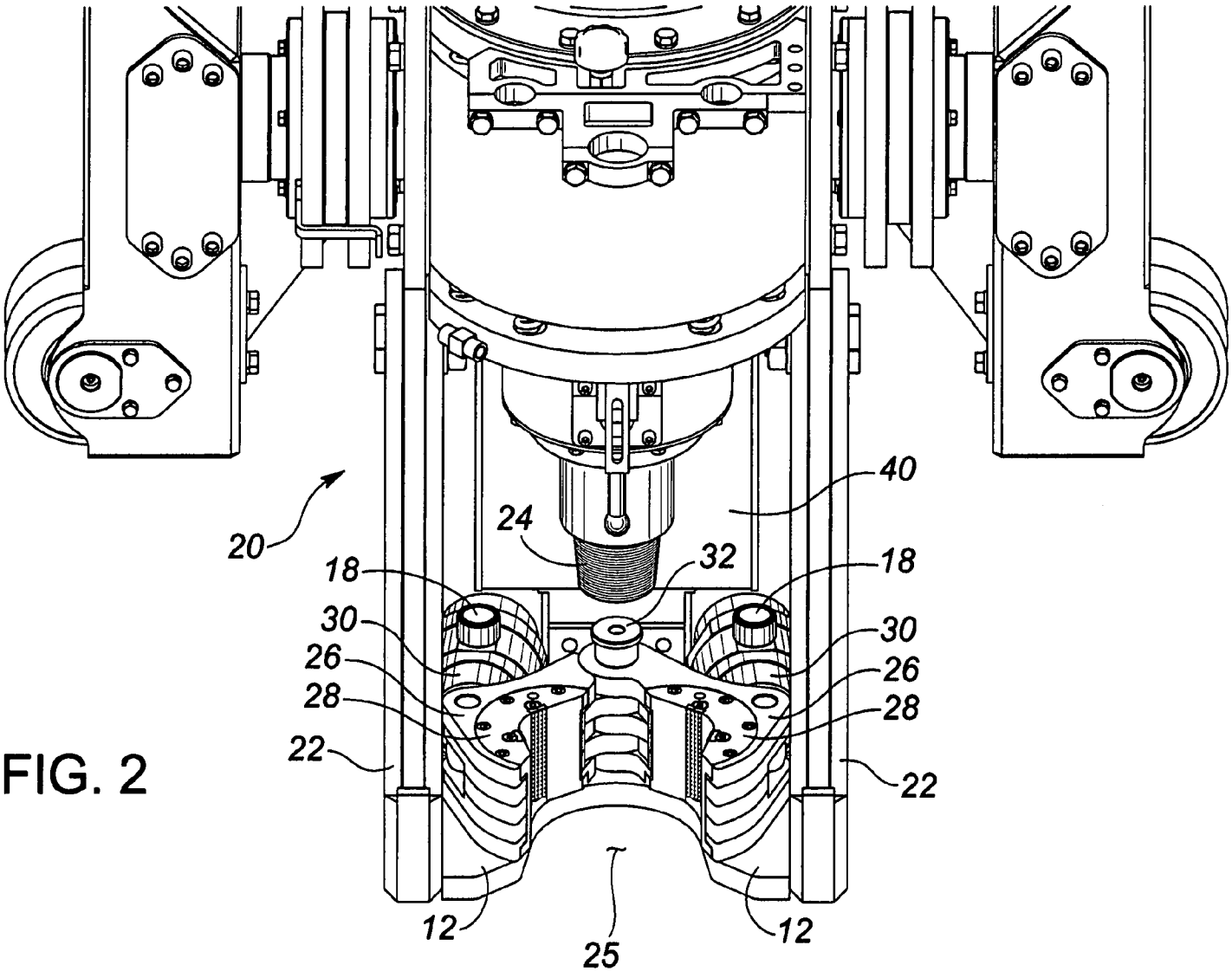
FIG. 2 is a front perspective view depicting the pipe gripping clamp of FIG. 1 with the top plate removed and the scissor jaws open.

Referring to FIG. 2, clamp assembly 10 is shown with top plate 14 removed to better illustrate scissor jaws 25. Scissor jaws 25 are pivotally attached to bottom plate 12 at jaw pivot 32. When top plate 14 is attached to clamp assembly 10, jaw pivot 32 extends through top plate 14. Also shown in FIG. 2 is a pair of rams 30. Each of rams 30 has an end that is pivotally attached to bottom plate 12 at ram pivots 18. The other end of each ram 30 is pivotally connected to a jaw 26. Each jaw 26 further comprises a jaw insert 28 that is the portion of jaw 26 that contacts the pipe being gripped by clamp assembly 10. Jaw insert 28 comprises a surface that easily grips a pipe and can be easily replaced when it becomes worn. Rams 30 may be hydraulically or pneumatically operated by control systems that are well known to those skilled in the art.

Figure 3:
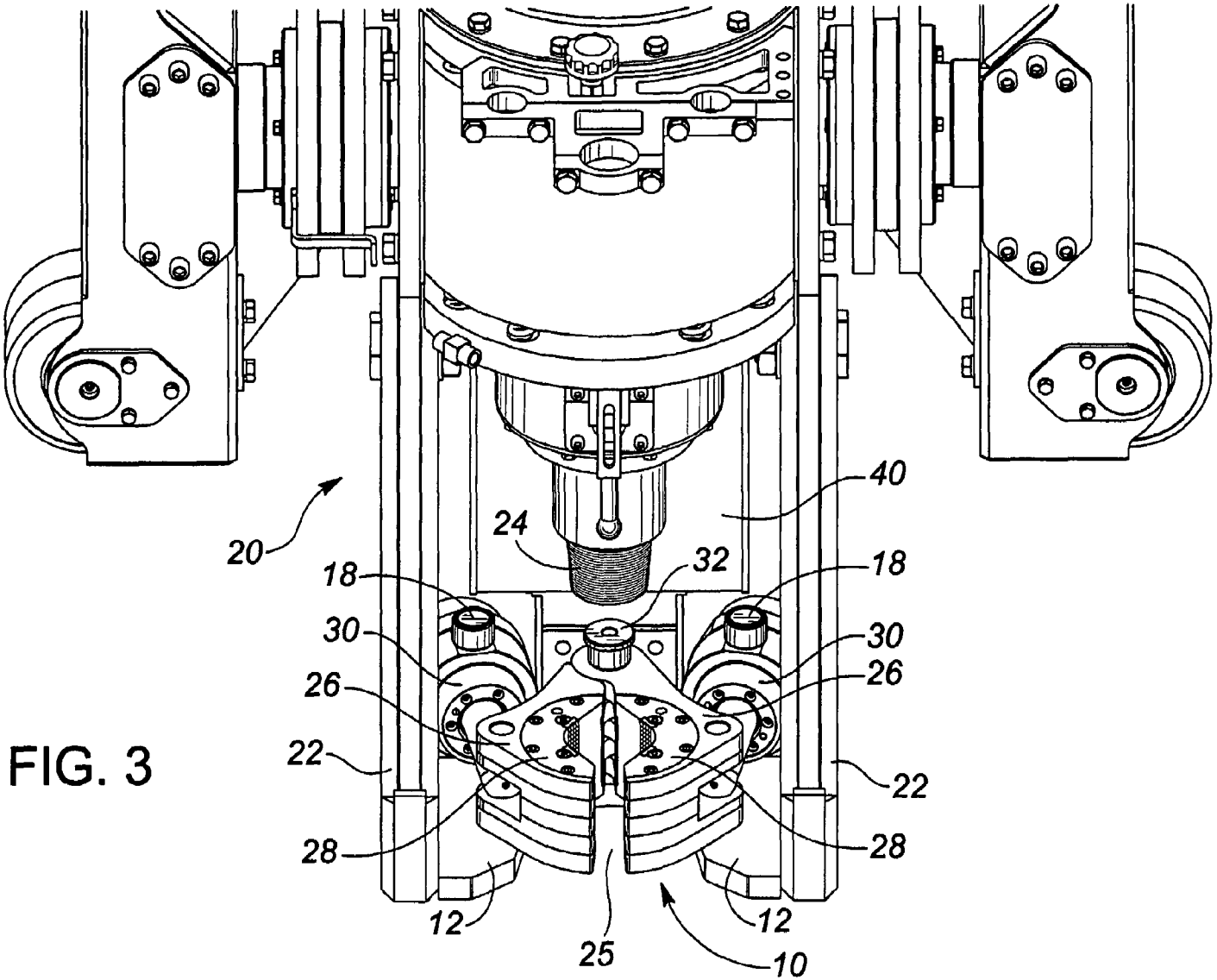
FIG. 3 is a front perspective view depicting the pipe gripping clamp of FIG. 1 with the top plate removed and the scissor jaws closed.
Figure 4:
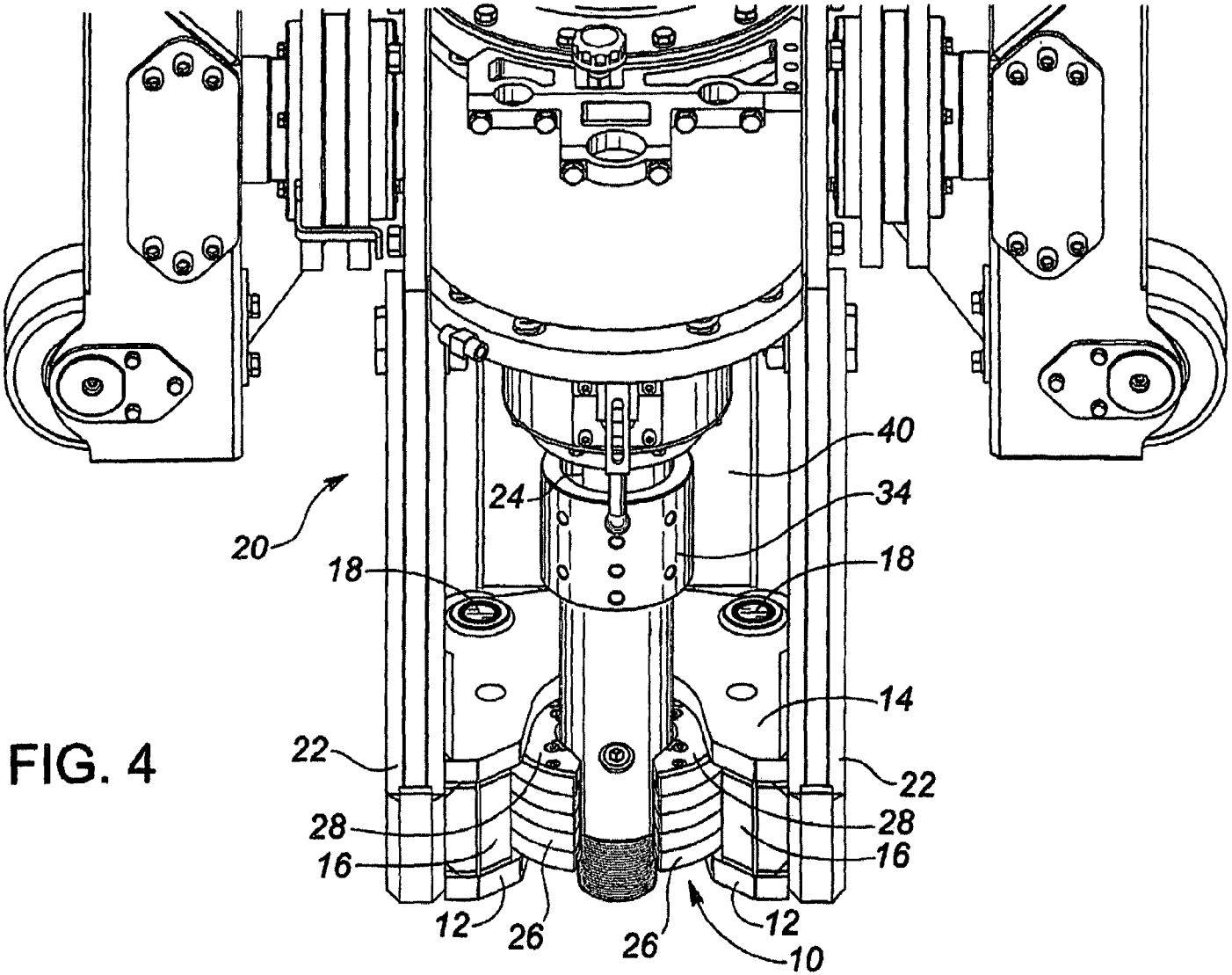
FIG. 4 is a front perspective view depicting the pipe gripping clamp of FIG. 1 with the scissor jaws closed about a valve sub-assembly.

Referring to FIG. 3, rams 30 are shown in an extended position such that each jaw 26 is pushed towards each other so that scissor jaws 25 are in a closed position. In FIG. 4, ball valve sub-assembly 36 (in FIG. 5) is shown attached to quill 24 and secured by thread lock 34 to illustrate the gripping action of scissor jaws 25 when in the closed position.

Figure 5:
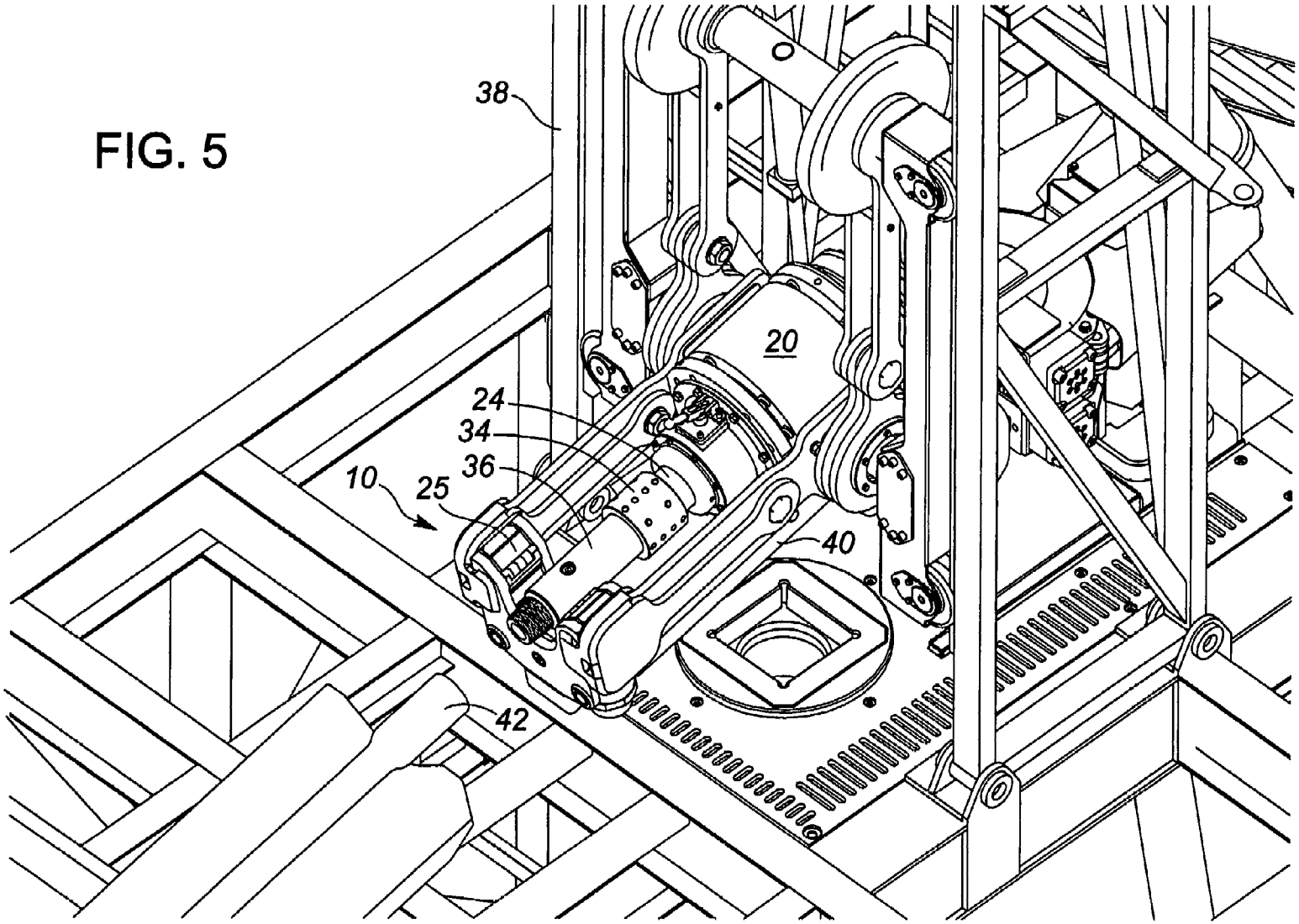
FIG. 5 is a perspective view depicting the top drive unit of the pipe gripping clamp in FIG. 1 shown in a raised position prior to gripping a section of pipe.
Figure 6:
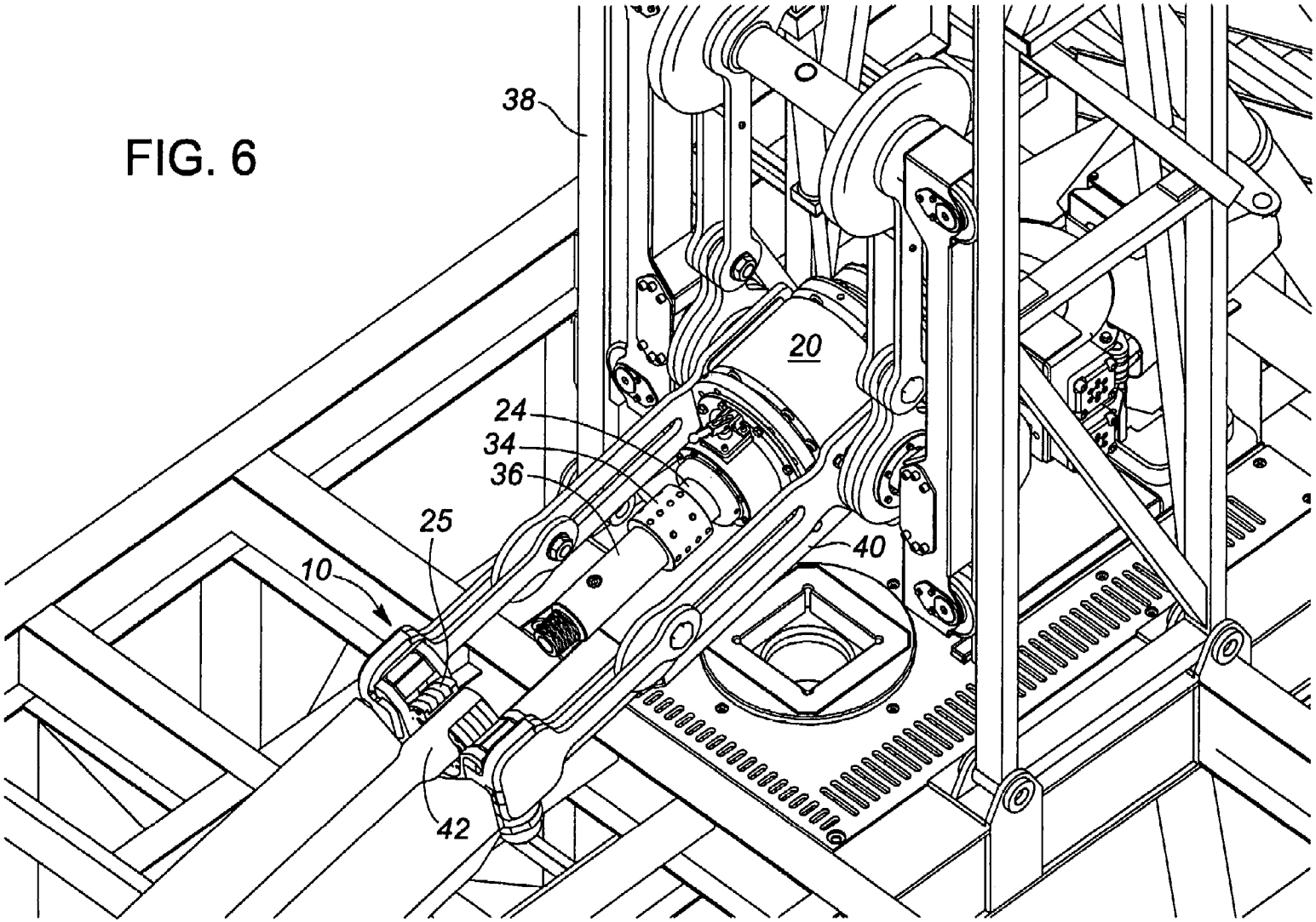
FIG. 6 is a perspective view depicting the top drive unit of FIG. 5 shown in a descended position to grip a section of pipe.
Figure 7:
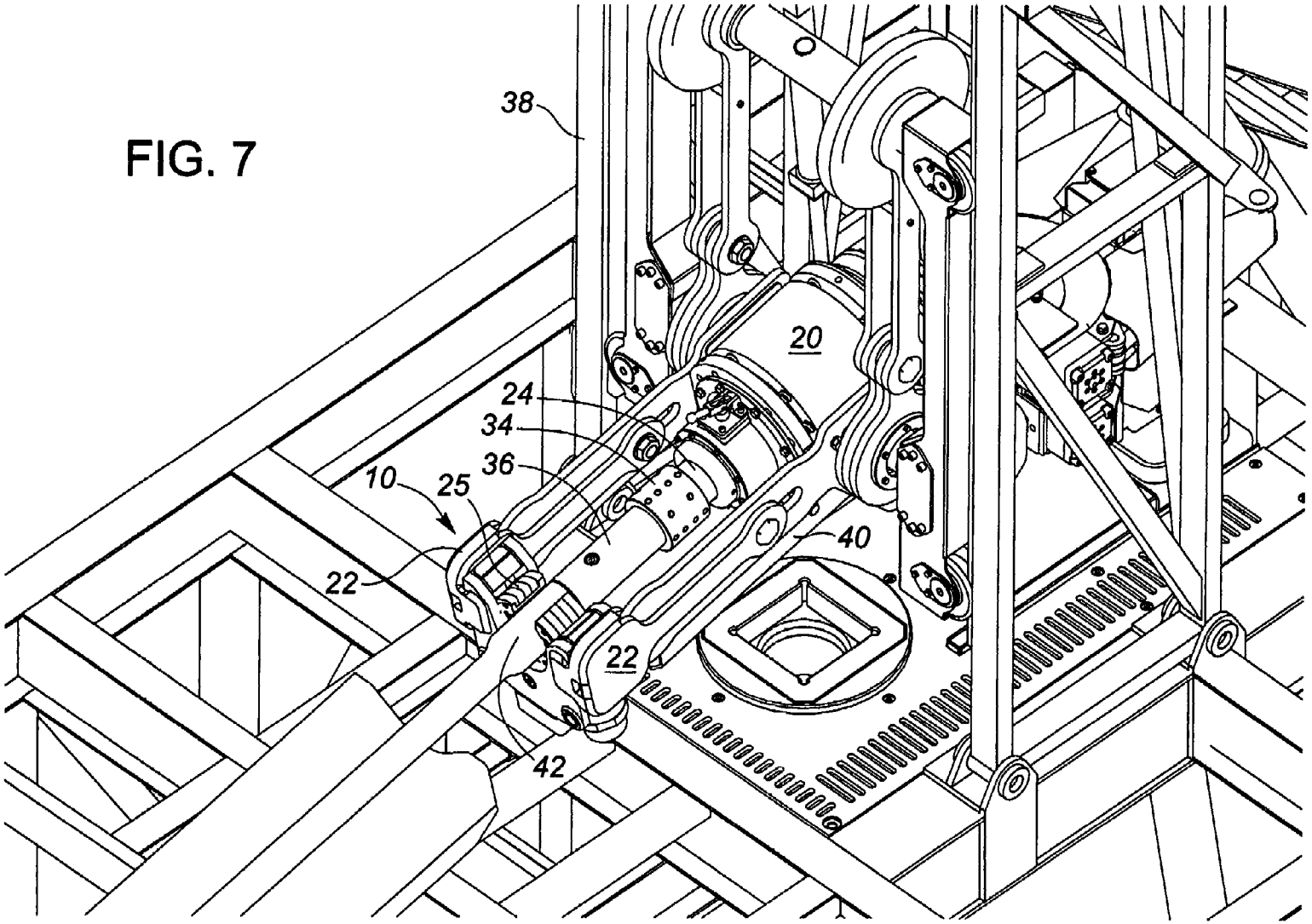
FIG. 7 is a perspective view depicting the top drive unit of FIG. 5 shown raising a section of pipe to be coupled to the top drive unit.

In FIGS. 5 to 7, a representative embodiment of the present invention is shown in the process of grasping and raising a section of pipe 42 to be coupled to top drive unit 20. In FIG. 5, top drive unit 20 is shown in a descended and tilted position so as to receive and threadably couple to pipe 42. Telescoping boom 40 is shown in its raised and retracted position whereby clamp assembly 10 is raised and scissor jaws 25 are open.

In FIG. 6, telescoping boom 40 is shown in a lowered and extended position such that scissor jaws 25 are straddling and clamped on pipe 42. In FIG. 7, telescoping boom 40 is shown partially retracted having raised pipe 42 towards valve sub-assembly 36 to be threadably coupled. Once pipe 42 has been securely coupled to valve sub-assembly 36, scissor jaws 25 are opened and telescoping boom 40 is further retracted to its fully raised position. Top drive unit 20 can then be raised in rig 38 thereby raising pipe 42 with it. Once top drive unit 20 is fully raised in rig 38, pipe 42 can be coupled to the drill string. When sections of pipe 42 are to be removed from the drill string, the process is reversed.

Although a few embodiments of the present invention have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A pipe gripping clamp, comprising:

(a) a bottom plate;

(b) a pair of jaws capable of gripping a pipe pivotally attached to said bottom plate, said jaws capable of pivoting about a pivot axis that is substantially perpendicular to said bottom plate; and (c) a ram operatively coupled to each jaw of said pair of jaws, each ram having two ends wherein one end is pivotally attached to said bottom plate and capable of pivoting about an axis that is substantially parallel to said pivot axis and the other end is pivotally attached to said jaw, whereby said pair of jaws closes to grip said pipe when said rams are extended and said pair of jaws opens to release said pipe when said rams are retracted; and (d) a top plate wherein said pair of jaws and said rams are disposed between said top and bottom plates and pivotally attached to said top plate.

2. The clamp as set forth in claim 1 wherein each jaw of said pair of jaws further comprises a detachable pipe gripping jaw insert.

3. The clamp as set forth in claim 1 wherein said rams are hydraulically or pneumatically operated.

4. A pipe gripping assembly for a top drive unit, comprising:

(a) a pipe gripping clamp sub-assembly, comprising:

(i) a bottom plate, (ii) a pair of jaws capable of gripping a pipe pivotally attached to said bottom plate, said jaws capable of pivoting about a pivot axis that is substantially perpendicular to said bottom plate, and (iii) a ram operatively coupled to each jaw of said pair of jaws, each ram having two ends wherein one end is pivotally attached to said bottom plate and capable of pivoting about an axis that is substantially parallel to said pivot axis and the other end is pivotally attached to said jaw, whereby said pair of jaws closes to grip said pipe when said rams are extended and said pair of jaws opens to release said pipe when said rams are retracted;

(b) a pair of guide rails operatively coupling said clamp sub-assembly to said top drive unit whereby said clamp sub-assembly is capable of moving towards and away from a quill operatively mounted on said top drive unit along said guide rails, said guide rails having an axis that is substantially parallel to the longitudinal axis of said quill; and (c) means for moving said clamp sub-assembly along said guide rails.

5. The assembly as set forth in claim 4 wherein said means for moving said clamp sub-assembly is a second ram operatively coupling said clamp sub-assembly to said top drive unit, said second ram being hydraulically or pneumatically operated.

* * * * *